US011812779B2

(12) United States Patent
Yue et al.

(10) Patent No.: US 11,812,779 B2
(45) Date of Patent: Nov. 14, 2023

(54) DEVICE FOR FORMING A MULTI-FLAVOR COMPOSITE STRUCTURE FILTER ROD IN ONE STEP AND A METHOD THEREOF USING THE DEVICE

(71) Applicant: CHINA TOBACCO YUNNAN INDUSTRIAL CO., LTD., Kunming (CN)

(72) Inventors: Baoshan Yue, Kunming (CN); Jianbo Zhan, Kunming (CN); Tao Wang, Kunming (CN); Yanfei Shen, Kunming (CN); Ying Zhang, Kunming (CN); Zhenhua Yu, Kunming (CN); Hao Wang, Kunming (CN); Yongfa Gui, Kunming (CN); Jiao Xie, Kunming (CN); Han Zheng, Kunming (CN); Tingting Yu, Kunming (CN); Yao Yu, Kunming (CN); Jiang Yu, Kunming (CN); Liwei Li, Kunming (CN); Xu Wang, Kunming (CN)

(73) Assignee: CHINA TOBACCO YUNNAN INDUSTRIAL CO., LTD., Kunming (CN)

( * ) Notice: Subject to any disclaimer, the term of this patent is extended or adjusted under 35 U.S.C. 154(b) by 0 days.

(21) Appl. No.: 18/176,823

(22) Filed: Mar. 1, 2023

(65) Prior Publication Data

US 2023/0320411 A1 Oct. 12, 2023

Related U.S. Application Data

(63) Continuation of application No. PCT/CN2022/086367, filed on Apr. 12, 2022.

(30) Foreign Application Priority Data

Apr. 11, 2022 (CN) ..... 202210375737.6

(51) Int. Cl.
*A24D 3/02* (2006.01)
*A24C 5/34* (2006.01)

(52) U.S. Cl.
CPC ..... *A24D 3/0287* (2013.01); *A24C 5/34* (2013.01); *A24D 3/0216* (2013.01);
(Continued)

(58) Field of Classification Search
CPC .. A24D 3/0287; A24D 3/0216; A24D 3/0225; A24D 3/0233; A24D 3/0254; A24D 3/0266; A24D 3/0295; A24C 5/34
(Continued)

(56) References Cited

U.S. PATENT DOCUMENTS 4,549,875 A * 10/1985 Pryor ..... A24D 3/022 493/44
7,074,170 B2 * 7/2006 Lanier, Jr. ..... A24D 3/022 493/44
(Continued)

FOREIGN PATENT DOCUMENTS

CN 1913791 B 11/2010

OTHER PUBLICATIONS

Written Opinion dated Dec. 12, 2022; International Application No. PCT/CN2022/086367; International Filing Date Apr. 12, 2022; 6 pages; China National Intellectual Property Administration (ISA/CN), Beijing, China.

*Primary Examiner* — Sameh Tawfik
(74) *Attorney, Agent, or Firm* — Andrew D. Fortney; Central California IP Group, P.C.

(57) ABSTRACT

The present disclosure concerns a device for forming a multi-flavor composite structure filter rod in one step, including the following components: a tow transmission belt, a tow guiding horn-shaped mouth, a tow assembly paper collection groove, a cigarette lap adhesive applying
(Continued)

device and multi-flavor adding devices. According to shapes and types of flavors, the multi-flavor adding devices are arranged in different sections to obtain one-step formation of the multi-flavor composite structure filter rods. The present disclosure also discloses a one-step method of forming the multi-flavor composite structure filter rod using the one-step forming device.

6 Claims, 1 Drawing Sheet

(52) U.S. Cl.
CPC ..... *A24D 3/0225* (2013.01); *A24D 3/0233* (2013.01); *A24D 3/0254* (2013.01); *A24D 3/0266* (2013.01); *A24D 3/0295* (2013.01)

(58) Field of Classification Search
USPC ..... 493/49, 4, 22, 31, 39, 44, 45, 50
See application file for complete search history.

(56) References Cited

U.S. PATENT DOCUMENTS

| | | | | |
|---|---|---|---|---|
| 7,300,394 | B2 * | 11/2007 | Buhl | A24D 3/0237 493/46 |
| 7,547,271 | B2 | 6/2009 | Kato | |
| 7,690,383 | B2 * | 4/2010 | Wada | A24C 5/005 131/37 |
| 7,972,254 | B2 * | 7/2011 | Stokes | A24D 3/061 493/47 |
| 8,381,736 | B2 * | 2/2013 | White | A24C 5/1892 131/88 |
| 8,992,400 | B2 * | 3/2015 | Righetti | A24D 3/0287 493/47 |
| 2005/0070409 | A1 * | 3/2005 | Deal | A24D 3/041 493/44 |
| 2006/0252622 | A1 * | 11/2006 | Kato | A24D 3/0225 493/39 |
| 2008/0029114 | A1 | 2/2008 | Seitert et al. | |

* cited by examiner

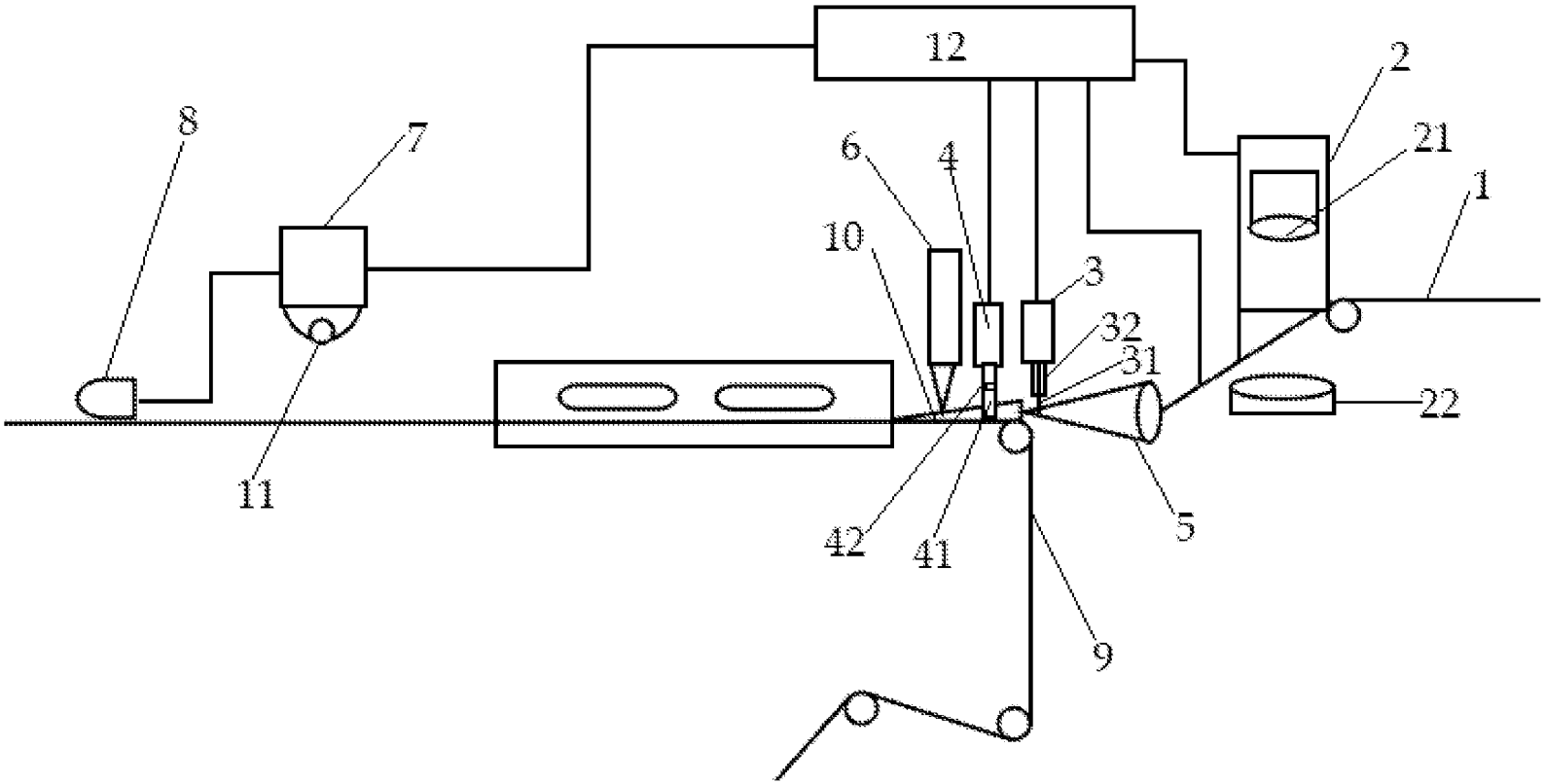
1
2
21
22
5
32
31
3
9
12
4
41
6
10
42
7
11
8

DEVICE FOR FORMING A MULTI-FLAVOR COMPOSITE STRUCTURE FILTER ROD IN ONE STEP AND A METHOD THEREOF USING THE DEVICE

CROSS-REFERENCE TO RELATED APPLICATIONS

This application is a continuation of International Pat. Appl. No. PCT/CN2022/086367, filed on Apr. 12, 2022, which claims the benefit of Chinese Pat. Appl. No. 2022103757376, filed on Apr. 12, 2022, both of which are incorporated herein by reference as if fully set forth herein.

FIELD OF THE INVENTION

The present disclosure belongs to the technical field of tobacco, and in particular, to a device for multi-flavor composite structure filter rod and a forming method thereof.

DISCUSSION OF THE BACKGROUND

Cigarette filters play an important role in reducing cigarette tar, thus bringing less harm to humans. Adding flavors to filter rods is an important method to improve cigarette taste. Flavoring filter rods can be of binary, ternary or multi-component composite structure. At present, there are many types of flavorings, such as gel, flavored threads, flavored tablets, granules, beads, etc. In order to avoid direct contact of flavoring materials with mouths, generally, composite structure filter rods are used, and the flavoring section is generally placed at the distal lip or end of composite structure filter rods.

Due to different structures between composite structure filter rods and ordinary cellulose acetate filter rods, processing techniques are also significantly different. Based on composite structure filter rod flavoring producing procedures in the prior art, filter rods containing gel, flavored threads, flavored tablets, granules, beads and other types of flavors are often first processed, then binary or multi-component compounding with cellulose acetate filter rods is conducted in the forming machine, so that composite structure filter rods with flavor sections can be produced.

Production of composite structure filter rods in the prior art requires two or more steps, generally, the more compound units, the more layers of forming paper are needed. Binary composite structure filter rods generally need two-step filter rod compounding with forming paper; ternary composite structure filter rods generally need three-step forming paper and two-step of compounding, with three layers of forming paper wrapped outside tows. Multi-layer forming paper may block micro-holes on the forming paper, filter rod ventilation and dilution requires the use of high air-permeability filter rod forming paper, or online laser drilling, which greatly increases filter rod costs and processing complexity. Besides, the length and composite ratio of composite structure filter rods in the prior art are fixed, the flavoring section has only one section and the length is fixed, and each time a different type of flavoring section is added, one compounding step and one layer of forming paper are required. Filter rods cannot be arbitrarily flavored with different types of flavors.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

The present disclosure is proposed to solve the problems above.

Through improving the formation processes of composite structure filter rods, the present disclosure realizes direct and/or automatic processing of multi-flavor composite structure filter rods on the forming device and processing of flavoring filter rod section on the forming device and a one-step formation of composite structure filter rods through locating and identifying as well as locating and cutting, and that the filter-rod length and composite ratio are controllable and adjustable, reducing the process flow, saving forming paper, thus reducing processing costs of filter rods and shortening processing time of composite structure filter rods, thus improving forming efficiency of filter rods.

Technical solutions of the present disclosure are as follows:

A first aspect of the present disclosure discloses a device for forming a multi-flavor composite structure filter rod in one step (a "one-step forming device"), comprising: a tow transmission belt, a tow guiding horn-shaped mouth, a tow assembly paper collection groove, a cigarette lap adhesive applying device and multi-flavor adding devices. The multi-flavor adding devices are arranged in different sections to obtain the multi-flavor composite structure filter rods.

Preferably, the flavors include granular flavors, gel flavors, and bead flavors.

Preferably, the tow guiding horn-shaped mouth is upstream of the tow assembly paper collection groove 10; the tow transmission belt enters from a larger opening of the tow guiding horn-shaped mouth into the tow guiding horn-shaped mouth and comes out from a smaller opening of the tow guiding horn-shaped mouth, which is close to the inlet opening of the tow assembly paper collection groove; and forming paper enters from an inlet opening of the tow assembly paper collection groove 10.

A granular flavor adding device is upstream of the tow guiding horn-shaped mouth, and the larger opening of the tow guiding horn-shaped mouth faces the granular flavor adding device; a gel flavor adding device is on or near the smaller opening of the tow guiding horn-shaped mouth; a bead flavor adding device is close to the inlet opening of the tow assembly paper collection groove; and the cigarette lap adhesive applying device is close to the outlet opening of the tow assembly paper collection groove.

Preferably, the granular flavor adding device is cylindrical and includes a granule sieve therein; and a granule collection device is below the tow transmission belt and opposite to the granular flavor adding device. The granule sieve is configured to prevent large flavor granules from entering tows, and the granule collection device is configured to collect flavor granules that fail to enter tows and that are thrown outside the tow transmission belt.

Preferably, the gel flavor adding device is cylindrical, and comprises a gel flavor applying needle tube in the lower part of the gel flavor adding device, including a nozzle penetrating into the tow guiding horn-shaped mouth. A gel flavor heating device on the gel flavor applying needle tube. The gel flavor applying needle tube is configured to measure the gel flavors added.

Preferably, the bead flavor adding device is cylindrical, and comprises a bead adding tube in the lower part of the bead flavor adding device, and nozzle of the bead adding tube penetrates into the tow assembly paper collection groove. A bead metering device may be on the bead adding tube.

Preferably, a locating and identifying device and a locating and cutting device are downstream of the tow assembly paper collection groove; and a locating and identifying probe is on the locating and identifying device. The locating and identifying device is configured to identify marks on the forming paper or the flavors, to ensure that cutting of multi-flavor composite structure filter rods is qualified, and that the flavors added are inside the composite structure filter rods.

Preferably, the one-step forming device also includes a control device. The control device is electrically connected to the tow transmission belt, the multi-flavor adding devices, the tow guiding horn-shaped mouth, the tow assembly paper collection groove, the cigarette lap adhesive applying device, the locating and identifying device, and the locating and cutting device.

A second aspect of the present disclosure discloses a one-step method for forming multi-flavor composite structure filter rods using the above one-step forming device, including the following steps:

Start the control device to cause the forming paper to enter the tow assembly paper collection groove; add granular flavors to tows on the tow transmission belt according to set programs using the granular flavor adding device; drive the tows with added granular flavors using the tow transmission belt to enter the tow guiding horn-shaped mouth from the larger opening; add gel flavors to tows at the smaller opening of the tow guiding horn-shaped mouth using the gel flavor adding device, then exit the tows from the small opening of the tow guiding horn-shaped mouth using the tow transmission belt; smooth the tows inside the tow guiding horn-shaped mouth and send the tows to the forming paper at the inlet opening of the tow assembly paper collection groove; drive the smoothed tows on the forming paper into the tow assembly paper collection groove, and add bead flavors near the inlet opening of the tow assembly paper collection groove using the bead flavor adding device; roll the tows with three kinds of added flavors into a cylindrical shape in the tow assembly paper collection groove; apply cigarette lap adhesive to edges of the forming paper rolled into a cylindrical shape near the outlet opening of the tow assembly paper collection groove using the cigarette lap adhesive applying device, bond edges of the forming paper together to form cylindrical filter rods; after bonding edges of the forming paper together, move the filter rods forward and dry them, then identify the filter rods using the locating and identifying probe on the locating and identifying device and cut the filter rods using the locating and cutting device to obtain the multi-flavor composite structure filter rod.

The above process is controlled by the control device, and the whole process is carried out automatically.

The length of the flavor section and the white rod section (i.e., the tow section without adding flavors) in cigarette filters can be programmed according to needs and be cut automatically in the one-step forming device. The control device may automatically control flavoring time and duration according to parameters set by the signals identified by the locating and identifying device and determine the proportions of composite structure filter rods, then transmit relevant signals to the filter rod locating and cutting device.

After establishing stable operation of the one-step forming device, automatic control is carried out based on distance from the position of flavoring to that of cutting, flavoring time, and operating speed of the forming device and flavoring duration. The control device calculates cutting positions and cutting time signals and inputs into the locating and cutting device, meanwhile, the control device receives cutting position signals from the locating and identifying device and sends to the cutting device, the locating and cutting device checks cutting positions and cutting time signals of filter rods, cutting can be carried out at marked positions as long as signals match, thus, filter rods of the same length can be produced in the same batch, and filter rods of various lengths or flavor types can be produced in different batches; if signals do not match, unqualified filter rods are eliminated, timing and time interval of adding flavors as well as the locating and cutting device are automatically corrected.

Preferably, marks can be added to the different flavors and identified by the locating and identifying device and input to the control device, and the control device calculates cutting positions and cutting time signals and checks cutting positions and cutting time signals according to positions and time of marks to improve accuracy of the filter rod length, composite ratio and cutting positions.

The present disclosure has the following beneficial effects:

1. The device for forming multi-flavor composite structure filter rods of the present disclosure is novel in design, which can be used for one-step formation of multi-component composite structure filter rods with different added shapes and types of flavors. The one-step forming device of the present disclosure simplifies the process flow for making composite structure filter rods, thus obviously improving working efficiency; the forming paper of the composite structure filter rod may have only one layer, and the amount of forming paper used is obviously reduced, thus greatly reducing costs. Composite structure filter rods in the prior art need to process flavoring filter rods first, then compound them with cellulose acetate filter rods to obtain composite structure filter rods, multi-layer forming paper is used during the process.
2. The one-step forming device for multi-flavor composite structure filter rods of the present disclosure is controlled by the control device, and the whole process is carried out automatically. The locating and identifying device can identify marks on forming paper or within flavors to ensure that composite structure filter rods are neatly and evenly cut by the locating and cutting device, and that granular flavors are inside composite structure filter rods without being cut.
3. The one-step forming device for multi-flavor composite structure filter rods of the present disclosure can add three kinds of flavors online (e.g., remotely, or by computer control), the composite ratio of the flavor section of filter rods to the white rod section of ordinary cellulose acetate filter rods and the total length of filter rods are controllable and adjustable online. According to set programs, the flavor section is added intermittently and regularly, and cut regularly so that the proximal lip or end of the filter rods for cigarette filters do not contain flavors. Flavoring can be carried out in multiple sections, and the content of flavors in different sections can be different, or there can be blank sections among multiple flavor sections. While the filter rod length and the composite ratio are fixed in the prior art, and the flavor section has only one section and the length is fixed, each additional flavor section requires an additional compounding step and an additional layer of forming paper. Changing the composite ratio of filter rods requires replacement and transformation of the forming machine components, and all set parameters need to be changed, resulting in longer processing time and lower work efficiency.

4. The multi-flavor composite structure filter rods obtained in the present disclosure has only one layer of forming paper. When tipping paper is pre-punched for ventilating and diluting air, there is no hole-blocking between forming papers, thus forming paper with low air-permeability can be used to reduce costs. Ordinary forming paper can be used in tipping paper online laser drilling, with smaller drilling power, higher degree of penetration, better ventilation stability, higher efficiency and lower costs.
5. The control device of the one-step forming device for multi-flavor composite structure filter rods of the present disclosure can calculate cutting positions and cutting time signals according to set programs, determine cutting positions and cutting time signals of composite structure filter rods based on positioning marks, and identify marks in flavors and calculate cutting positions and cutting time signals. The control device realizes double-signal input judgment to ensure accuracy of filter rod length, composite ratio and cutting positions, thus improving stability of the filter rod formation process.
6. The one-step forming device for multi-flavor composite structure filter rods of the present disclosure, can add up to three kinds of flavors and form a multi-flavor composite structure filter rod at one time. Different types of flavors are added in diverse ways, e.g., as for adding bead flavors, filter rod forming shall be carried out immediately after adding flavors, while granular flavors can be added to tows openly. The one-step method for forming multi-flavor composite structure filter rod of the present disclosure can also provide a new idea for one-step formation of flavors of other types and states.

These and other advantages of the present invention will become readily apparent from the detailed description of various embodiments below.

BRIEF DESCRIPTION OF THE DRAWING

FIG. 1 is a schematic view of the one-step forming device for multi-flavor composite structure filter rods of the present disclosure.

The names of reference signs in the FIGURE are as follows: 1. Tow transmission belt, 2. Granular flavor adding device, 21. Granule sieve, 22. Granule collection device, 3. Gel flavor adding device, 31. Gel flavor applying needle tube, 32. Gel flavor heating device, 4. Bead flavor adding device, 41. Bead adding tube, 42. Bead metering device, 5. Tow guiding horn-shaped mouth, 6. Cigarette lap adhesive applying device, 7. Locating and identifying device, 8. Locating and cutting device, 9. Forming paper, 10. Tow assembly paper collection groove, 11. Locating and identifying probe, 12. Control device.

DETAILED DESCRIPTION

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention. Furthermore, it should be understood that the possible permutations and combinations described herein are not meant to limit the invention. Specifically, variations that are not inconsistent may be mixed and matched as desired.

The technical proposal(s) of embodiments of the present invention will be fully and clearly described in conjunction with the drawings in the following embodiments. It will be understood that the descriptions are not intended to limit the invention to these embodiments. Based on the described embodiments of the present invention, other embodiments can be obtained by one skilled in the art without creative contribution and are in the scope of legal protection given to the present invention.

Furthermore, all characteristics, measures or processes disclosed in this document, except characteristics and/or processes that are mutually exclusive, can be combined in any manner and in any combination possible. Any characteristic disclosed in the present specification, claims, Abstract and FIGURES can be replaced by other equivalent characteristics or characteristics with similar objectives, purposes and/or functions, unless specified otherwise.

In order to make the purpose, technical solutions and beneficial effects of the present invention clearer, the following will be illustrated in detail in combination with the embodiments to facilitate the understanding of persons skilled in the art.

The present invention is further illustrated below by the embodiments, but not limited to the embodiments. Experimental methods with no specific conditions in the embodiments, are usually in accordance with the conventional conditions and conditions described in the manual, or general equipment, materials, reagents, etc. used in the conditions recommended by manufacturers, unless otherwise specified, are available commercially. Raw materials used in the following embodiments and comparison(s) are all commercially available.

As shown in FIG. 1, a one-step forming device for multi-flavor composite structure filter rod includes the following components: a tow transmission belt 1, a tow guiding horn-shaped mouth 5, a tow assembly paper collection groove 10, a cigarette lap adhesive applying device 6 and multi-flavor adding devices. According to the shapes and types of the flavors, the multi-flavor adding devices are arranged in different sections to obtain one-step formation of the multi-flavor composite structure filter rods.

The flavors added in various embodiments are granular flavors, gel flavors and bead flavors.

Positions and timing for adding the three kinds of flavors are as follows: the tow guiding horn-shaped mouth 5 is upstream of the tow assembly paper collection groove 10; the tow transmission belt 1 enters from the large opening of the tow guiding horn-shaped mouth 5 into the tow guiding horn-shaped mouth 5 and comes out from its small opening, which is close to the inlet opening of the tow assembly paper collection groove 10. Forming paper 9 also enters the inlet opening of the tow assembly paper collection groove 10.

The multi-flavor adding devices include a granular flavor adding device 2, a gel flavor adding device 3, and a bead flavor adding device 4. The granular flavor adding device 2 is upstream of the tow guiding horn-shaped mouth 5, and the large opening of the tow guiding horn-shaped mouth 5 faces the granular flavor adding device 2. The gel flavor adding device 3 is at the small opening of the tow guiding horn-shaped mouth 5. The bead flavor adding device 4 is close to the inlet opening of the tow assembly paper collection groove 10. The cigarette lap adhesive applying device 6 is close to the outlet opening of the tow assembly paper collection groove 10.

The granular flavor adding device 2 is cylindrical, with a granule sieve 21 inside. A granule collection device 22 is configured below the tow transmission belt 1 opposite to the granular flavor adding device 2. The granule sieve 21 is to prevent larger flavor granules from entering tows, and the granule collection device 22 is to collect flavor granules that fail to enter tows and are thrown outside the tow transmission belt 1.

The gel flavor adding device 3 is cylindrical, and, a gel flavor applying needle tube 31 is in the lower part of the gel flavor adding device 3. A nozzle of the gel flavor applying needle tube 31 penetrates into the tow guiding horn-shaped mouth 5. A gel flavor heating device 32 is on the gel applying needle tube 31.

Preferably, the bead flavor adding device 4 is cylindrical, and a bead adding tube 41 is in the lower part of the bead flavor adding device 4, A nozzle of the bead adding tube 41 penetrates into the tow assembly paper collection groove 10. A bead metering device 42 is on the bead adding tube 41.

A locating and identifying device 7 and a locating and cutting device 8 are downstream of the assembling tow forming paper collection groove 10; a locating and identifying probe 11 is on the locating and identifying device 7. The locating and identifying device 7 is configured to identify marks on forming paper or the flavors, to ensure that cutting of multi-flavor composite structure filter rods is qualified, and that the flavors added are inside composite structure filter rods.

In some embodiments, the one-step forming device also includes a control device 12. The control device 12 is electrically connected to the tow transmission belt 1, the flavor adding devices, the tow guiding horn-shaped mouth 5, the tow assembly paper collection groove 10, the cigarette lap adhesive applying device 6, and the locating and identifying device 7 as well as the locating and cutting device 8.

The present disclosure uses the above one-step forming device to carry out a one-step method of forming a multi-flavor composite structure filter rod, including the following steps:

Start the control device 12, and the forming paper 9 begins to enter the tow assembly paper collection groove 10. Meanwhile, the granular flavor adding device 2 adds granular flavors to tows on the tow transmission belt 1 according to set programs (e.g., in the control device 12). Granular flavors (e.g., flavor granules) are screened by the granule sieve 21 before or during addition to prevent larger flavor granules from entering the tows. Flavor granules that fall or are thrown outside the tow transmission belt 1 are collected by the granule collection device 22. The tow transmission belt 1 drives the tows with added granular flavors on the belt to enter the tow guiding horn-shaped mouth 5 from the large opening of the tow guiding horn-shaped mouth 5. The gel flavor adding device 3 adds gel flavors to the tows at the smaller opening of the tow guiding horn-shaped mouth 5, and the tows come out from the smaller opening of the tow guiding horn-shaped mouth. Gel flavors are first heated by the gel heating device 32 and added by the gel flavor applying needle tube 31 to the tows. Meanwhile, the tows are smoothed in the guiding horn-shaped mouth 5 and sent to the forming paper 9 at the inlet opening of the tow assembly paper collection groove 10. At this time, the forming paper 9 drives or carries the smoothed tows on the forming paper 9 into the tow assembly paper collection groove 10, and the bead flavor adding device 4 adds bead flavors near the inlet opening of the tow assembly paper collection groove 10. Bead flavors are added from the bead flavor adding tube 41 and measured by the bead metering device 42. Not all tows will necessarily have all three flavors added thereto. However, the tows with three different kinds of added flavors are rolled into a cylindrical shape in the tow assembly paper collection groove 10. The cigarette lap adhesive applying device 6 applies cigarette lap adhesive to edges of the forming paper 9 rolled into a cylindrical shape near the outlet opening of the tow assembly paper collection groove 10. The edges of the forming paper are bonded together and become cylindrical filter rods. After the edges of the forming paper 9 are bonded together, the filter rods continue to move forward. They are dried (e.g., in the unnumbered oven in FIG. 1 downstream from the tow assembly paper collection groove 10), then identified by the locating and identifying probe 11 on the locating and identifying device 7 and cut by the locating and cutting device 8, thus providing the multi-flavor composite structure filter rods.

The above processes are controlled by the control device 12, the whole process is carried out automatically.

The length of flavor section and white rod section (i.e., the tow section without adding flavors) in the cigarette filter can be programmed according to needs and cut automatically in the one-step forming device. The control device 12 may automatically control flavoring time and duration according to parameters set by the signals identified by the locating and identifying device 7, as well as proportions of composite structure filter rods, and transmit relevant signals to the filter rod locating and cutting device 8. After establishing stable operation of the one-step forming device, automatic control is carried out based on the distance from the position of the flavor adding devices to that of the cutting device, the flavoring time, the operating speed of the one-step forming device, and the flavoring duration. The control device 12 calculates cutting positions and cutting time signals and inputs into the locating and cutting device 8, meanwhile, the control device 12 receives cutting position signals from the locating and identifying device 7, and sends filter rod cutting positions and cutting time signals to the cutting device 8. The locating and cutting device 8 checks filter rod cutting positions and cutting time signals, and cutting can be carried out at marked positions as long as those signals match. Thus, filter rods of the same length can be produced in the same batch, and filter rods of various lengths or flavor types can be produced in different batches. If the signals do not match, unqualified filter rods can be eliminated, or the timing and time interval of adding flavors as well as the locating and cutting device operations are automatically corrected. Finally, composite structure filter rods can be obtained that are neat and uniform, which ensures that granular flavors are inside without being cut.

Besides, marks can be added to different flavors, and such marks can be identified by the locating and identifying device 7 and input to the control device 12. The control device 12 calculates cutting positions and cutting time signals and checks cutting positions and cutting time signals with positions and time of marks according to the positions and time of marks to improve accuracy of the filter rod length, composite ratio and cutting positions.

The above is only specific embodiments of the present disclosure. However, the protection scope of the present disclosure is not limited thereto. Any changes or substitutions that are thought of without creative work should be included within the protection scope of the present disclosure. Therefore, the protection scope of the present disclosure should be subject to the protection scope of the claims.

What is claimed is:

1. A device for forming a multi-flavor composite structure filter rod in one step, comprising: a tow transmission belt, a tow guiding horn-shaped mouth, a tow assembly paper collection groove, a cigarette lap adhesive applying device, multi-flavor adding devices adding flavors to the filter rod, a locating and identifying device and a locating and cutting device downstream of the tow assembly paper collection groove, a locating and identifying probe on the locating and identifying device, and a control device electrically connected to the tow transmission belt, the multi-flavor adding devices, the tow guiding horn-shaped mouth, the tow assembly paper collection groove, the cigarette lap adhesive applying device, the locating and identifying device, and the locating and cutting device; wherein the multi-flavor adding devices are arranged in different sections to obtain one-step formation of the multi-flavor composite structure filter rods; the flavors comprise granular flavors, gel flavors and bead flavors; the tow guiding horn-shaped mouth is upstream of the tow assembly paper collection groove; the tow transmission belt enters from a larger opening of the tow guiding horn-shaped mouth into the tow guiding horn-shaped mouth and comes out from a smaller opening of the tow guiding horn-shaped mouth, which is close to an inlet opening of the tow assembly paper collection groove; forming paper enters from an inlet opening of the tow assembly paper collection groove; a granular flavor adding device is configured upstream of the tow guiding horn-shaped mouth, and the larger opening of the tow guiding horn-shaped mouth faces the granular flavor adding device; a gel flavor adding device is at the smaller opening of the tow guiding horn-shaped mouth; a bead flavor adding device is close to the inlet opening of the tow assembly paper collection groove; and the cigarette lap adhesive applying device is close to an outlet opening of the tow assembly paper collection groove.

2. The device for forming the multi-flavor composite structure filter rod in one step according to claim 1, wherein the granular flavor adding device is cylindrical and includes a granule sieve therein; and the device for forming the multi-flavor composite structure filter rod in one step further comprises a granule collection device below the tow transmission belt, opposite to the granular flavor adding device.

3. The device for forming the multi-flavor composite structure filter rod in one step according to claim 1, wherein the gel flavor adding device is cylindrical, and comprises a gel flavor applying needle tube in a lower part thereof and a gel flavor heating device on the gel applying needle tube; and the gel flavor applying needle tube comprises a nozzle penetrating into the tow guiding horn-shaped mouth.

4. The device for forming the multi-flavor composite structure filter rod in one step according to claim 1, wherein the bead flavor adding device is cylindrical and comprises a bead adding tube in a lower part thereof and a bead metering device on the bead adding tube, the bead adding tube comprising a nozzle penetrating into the tow assembly paper collection groove.

5. A method for forming a multi-flavor composite structure filter rod using the device for forming the multi-flavor composite structure filter rod of claim 1, comprising:

starting the control device to cause the forming paper to enter the tow assembly paper collection groove;

adding granular flavors to tows on the tow transmission belt according to set programs using the granular flavor adding device;

driving the tows with added granular flavors on the tow transmission belt to enter the tow guiding horn-shaped mouth (5) from the larger opening of the tow guiding horn-shaped mouth, adding gel flavors to the tows at the smaller opening of the tow guiding horn-shaped mouth using the gel flavor adding device, exiting the tow transmission belt with the tows from the smaller opening of the tow guiding horn-shaped mouth;

smoothing the tows inside the tow guiding horn-shaped mouth and sending the tows to the forming paper at the inlet opening of the tow assembly paper collection groove;

driving the smoothed tows on the forming paper into the tow assembly paper collection groove, adding the bead flavors near the inlet opening of the tow assembly paper collection groove using the bead flavor adding device;

rolling the tows with three added flavors into a cylindrical shape in the tow assembly paper collection groove;

applying cigarette lap adhesive to edges of the forming paper rolled into a cylindrical shape near the outlet opening of the tow assembly paper collection groove using the cigarette lap adhesive applying device, bonding edges of the forming paper together to obtain cylindrical filter rods;

after the edges of the forming paper are bonded together, moving the filter rods forward and drying the filter rods, then identifying the filter rods using the locating and identifying probe on the locating and identifying device and cutting the filter rods with the locating and cutting device, thus obtaining the multi-flavor composite structure filter rod.

6. The method of claim 5, further comprising controlling the method with the control device, and carrying out the method automatically.

* * * * *